US010339880B2

(12) United States Patent
Xing et al.

(10) Patent No.: US 10,339,880 B2
(45) Date of Patent: Jul. 2, 2019

(54) DRIVE METHOD OF RGBW FOUR PRIMARY COLORS DISPLAY PANEL

(71) Applicant: Wuhan China Star Optoelectronics Technology Co., Ltd., Wuhan (CN)

(72) Inventors: Zhenzhou Xing, Wuhan (CN); Feilin Ji, Wuhan (CN); Taisheng An, Wuhan (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 360 days.

(21) Appl. No.: 15/505,103

(22) PCT Filed: Dec. 27, 2016

(86) PCT No.: PCT/CN2016/112438
§ 371 (c)(1),
(2) Date: Feb. 20, 2017

(87) PCT Pub. No.: WO2018/094803
PCT Pub. Date: May 31, 2018

(65) Prior Publication Data

US 2019/0156768 A1 May 23, 2019

(30) Foreign Application Priority Data

Nov. 28, 2016 (CN) ..... 2016 1 1067061

(51) Int. Cl.
*G09G 3/36* (2006.01)
*G09G 3/20* (2006.01)

(52) U.S. Cl.
CPC ..... *G09G 3/3607* (2013.01); *G09G 3/2074* (2013.01); *G09G 3/3677* (2013.01);
(Continued)

(58) Field of Classification Search
CPC .. G09G 3/3208; G09G 3/3275; G09G 3/3607; G09G 3/3614; G09G 3/3688;
(Continued)

(56) References Cited

U.S. PATENT DOCUMENTS 9,841,647 B2 * 12/2017 Guo ..... G02F 1/133514
10,008,163 B1 * 6/2018 Cui ..... G09G 3/3208
(Continued)

FOREIGN PATENT DOCUMENTS

CN 105590600 A 5/2016
CN 105609079 A 5/2016

*Primary Examiner* — Vijay Shankar
(74) *Attorney, Agent, or Firm* — Leong C. Lei

(57) ABSTRACT

Provided is a drive method of a RGBW four primary colors display panel, for a drive architecture of driving eight columns of sub pixels by two source drive lines with multiplexing, adjusting an enable sequence of a red, a green, a blue and a white sub pixel switch control signals in a multiplex module to make that a duration of a portion of pulse high voltage levels in at least two sub pixel switch control signals is ½ of a duration of a pulse high voltage level of a gate scan signal, and middle points of the portion of pulse high voltage levels are aligned with a rising edge of one of three adjacent gate scan signals and a falling edge of one of the other two gate scan signals to reduce a switch frequency of a corresponding sub pixel switch control signal.

11 Claims, 5 Drawing Sheets

(52) U.S. Cl.
CPC ..... *G09G 2300/0452* (2013.01); *G09G 2310/0297* (2013.01); *G09G 2310/06* (2013.01); *G09G 2330/021* (2013.01)

(58) Field of Classification Search
CPC ... G09G 2300/0426; G09G 2300/0452; G09G 2310/0254; G09G 2310/0291; G09G 2310/0297; G09G 2320/0247; G09G 2330/021; G09G 2340/0457
See application file for complete search history.

(56) References Cited

U.S. PATENT DOCUMENTS

| | | | | |
|---|---|---|---|---|
| 10,114,261 | B2 * | 10/2018 | Huang | G02F 1/13306 |
| 10,115,352 | B2 * | 10/2018 | Xing | G09G 3/3406 |
| 2001/0010512 | A1 | 8/2001 | Azami | |
| 2007/0057877 | A1 * | 3/2007 | Choi | G09G 3/3233 345/76 |
| 2017/0061872 | A1 * | 3/2017 | Zhou | G09G 3/3233 |

* cited by examiner

DRIVE METHOD OF RGBW FOUR PRIMARY COLORS DISPLAY PANEL

FIELD OF THE INVENTION

The present invention relates to a display technology field, and more particularly to a drive method of a RGBW four primary colors display panel.

BACKGROUND OF THE INVENTION

The LCD (Liquid Crystal Display) comprises a plurality of pixels aligned in array. As shown in FIG. 1, each pixel generally comprises sub pixels of three colors, the red sub pixels R, the green sub pixels G, the blue sub pixels B. Each sub pixel is controlled by one gate line and one data line. The gate line is employed to control the on and off of the sub pixel, and the data line applies various data voltage signals to make the sub pixel show various gray scales, and thus for realizing the full color image display.

With the development of display technology, people has higher and higher demands for the display qualities, such as the display brightness, the color reducibility and the richness of image colors. The display panel, which merely uses the red, the green and the blue, three primary colors, can no longer satisfy the requirements of the people. Then, a four primary colors display panel consisted of red, green, blue, white, four colors is proposed. Specifically, a white sub pixel is added in each pixel to form the RGBW pixel structure shown in FIG. 2 composed by the red sub pixel R, the green sub pixel G, the blue sub pixel B and the white sub pixel W. The RGBW four primary colors display panel possesses higher transmission rate than the RGB three primary colors display panel as showing the same display image, and can reduce the ⅓ of pixel amount to lower the production yield risk of ultra high resolution under the premise of the constant resolution with use of the sub pixel sharing algorithm. Meanwhile, the backlight power consumption is decreased 40% and the picture contrast can be raised, and thus is subjected to the consumer trackhold.

With the rapid development of the LCD technology, the requirement of the people for the LCD clarity has become higher and higher. Namely, the demand for the display panel resolution gets higher and higher; meanwhile, due to the increase of the resolution, the amount of the source line of executing the output control gets more and more. At present, the main stream method is to respectively charge each column of pixels with the multiplex module (MUX) switching the time division multiplexing to achieve the objective of decreasing the amount of source lines. However, each switch control signal in the multiplex module must be switched with a certain switch frequency for being able to drive the entire display panel to normally display.

Most of the present RGBW four primary colors display panels utilizes a drive architecture of driving eight columns of sub pixels (2 to 8 De-mux) by two source drive lines with multiplexing and is generally applied for the Column inversion. The RGBW four primary colors display panel comprises a plurality of drive units, and as shown in FIG. 3, each unit comprising one multiplex module 10 and a first column of pixels P1 and a second column of pixels P2. Either of the first column of pixels P1 and the second column of pixels P2 comprising a red sub pixel R, a green sub pixel G, a blue sub pixel B and a white sub pixel W which are located from left to right in order. The multiplex module 10 comprises a first thin film transistor T1, a second thin film transistor T2, a third thin film transistor T3, a fourth thin film transistor T4, a fifth thin film transistor T5, a sixth thin film transistor T6, a seventh thin film transistor T7, an eighth thin film transistor T8 which are located from left to right in order: a gate of the first thin film transistor T1 receiving the red sub pixel switch control signal MUXR, and a source receiving a first source drive signal S1 through a first source drive line L1, and a drain being coupled to the red sub pixel R in the first column of pixels P1; a gate of the second thin film transistor T2 receiving the green sub pixel switch control signal MUXG, and a source receiving the first source drive signal S1 through the first source drive line L1, and a drain being coupled to the green sub pixel G in the second column of pixels P2; a gate of the third thin film transistor T3 receiving the blue sub pixel switch control signal MUXB, and a source receiving the first source drive signal S1 through the first source drive line L1, and a drain being coupled to the blue sub pixel B in the second column of pixels P2; a gate of the fourth thin film transistor T4 receiving the white sub pixel switch control signal MUXW, and a source receiving the first source drive signal S1 through the first source drive line L1, and a drain being coupled to the white sub pixel W in the first column of pixels P1; a gate of the fifth thin film transistor T5 receiving the red sub pixel switch control signal MUXR, and a source receiving a second source drive signal S2 through a second source drive line L2, and a drain being coupled to the red sub pixel R in the second column of pixels P2; a gate of the sixth thin film transistor T6 receiving the green sub pixel switch control signal MUXG, and a source receiving the second source drive signal S2 through the second source drive line L2, and a drain being coupled to the green sub pixel G in the first column of pixels P1; a gate of the seventh thin film transistor T7 receiving the blue sub pixel switch control signal MUXB, and a source receiving the second source drive signal S2 through the second source drive line L2, and a drain being coupled to the blue sub pixel B in the first column of pixels P1; a gate of the eighth thin film transistor T8 receiving the white sub pixel switch control signal MUXW, and a source receiving the second source drive signal S2 through the second source drive line L2, and a drain being coupled to the white sub pixel W in the second column of pixels P2. Besides, the first source drive signal S1 is amplified by a first amplifier AMP1, and the second source drive signal S2 is amplified by a second amplifier AM P2.

FIG. 4 is a sequence circuit diagram of a drive unit in a RGBW four primary colors display panel shown in FIG. 3. The waveforms of the red sub pixel switch control signal MUXR, the green sub pixel switch control signal MUXG, the blue sub pixel switch control signal MUXB and the white sub pixel switch control signal MUXW are the same but only the generation points of the first pulses are distinct. Meanwhile, a sum of the durations of the pulse high voltage levels of the four pixel switch control signals MUXR, MUXG, MUXB, MUXW is equal to Combining FIG. 3 and FIG. 4, at present, the drive process of the RGBW four primary colors display panel is:

the gate scan signal is generated row by row, and as the nth gate scan signal Gate (n) comes, the nth row of sub pixels are all enabled. First, the red sub pixel switch control signal MUXR is pulled up, and the rest green sub pixel switch control signal MUXG, blue sub pixel switch control signal MUXB and white sub pixel switch control signal MUXW are all pulled down, and only the first thin film transistor T1 and the fifth thin film transistor T1 are activated, and the first source drive signal S1 and the second source drive signal S2 start charging the nth row of the red sub pixels R, and after one clock cycle, the charge to the red sub pixels R is accomplished;

then, the green sub pixel switch control signal MUXG is pulled up, the rest red sub pixel switch control signal MUXR, blue sub pixel switch control signal MUXB and white sub pixel switch control signal MUXW are all pulled down, and only the second thin film transistor T2 and the sixth thin film transistor T6 are activated, and the first source drive signal S1 and the second source drive signal S2 start charging the nth row of the green sub pixels G, and after one clock cycle, the charge to the green sub pixels G is accomplished;

then, the blue sub pixel switch control signal MUXB is pulled up, the rest red sub pixel switch control signal MUXR, green sub pixel switch control signal MUXG and white sub pixel switch control signal MUXW are all pulled down, and only the third thin film transistor T3 and the seventh thin film transistor T7 are activated, and the first source drive signal S1 and the second source drive signal S2 start charging the nth row of the blue sub pixels B, and after one clock cycle, the charge to the blue sub pixels B is accomplished;

finally, the white sub pixel switch control signal MUXW is pulled up, the rest red sub pixel switch control signal MUXR, green sub pixel switch control signal MUXG and blue sub pixel switch control signal MUXB are all pulled down, and only the fourth thin film transistor T4 and the eighth thin film transistor T8 are activated, and the first source drive signal S1 and the second source drive signal S2 start charging the nth row of the white sub pixels W, and after one clock cycle, the charge to the white sub pixels W is accomplished.

Next, as the n+1th gate scan signal Gate (n+1) comes, the aforesaid process is repeated;

As the n+2th gate scan signal Gate (n+2) comes, the aforesaid process is repeated, again;

Accordingly, the red sub pixel switch control signal MUXR, the green sub pixel switch control signal MUXG, the blue sub pixel switch control signal MUXB and the white sub pixel switch control signal MUXW must perform the level switch for every row. Namely, the switch frequency of one frame must be M times (M is the row amount of RGBW four primary colors display panel resolution) for satisfying the requirement of the normal work of the RGBW four primary colors display panel. Thus, it will lead to the too fast switch frequency of the multiplex module 10. According to the power consumption calculation formula of the multiplex module:

$$Powermux=Cmux\times Vmux2\times fmux$$

wherein Powermux is the power consumption of the multiplex module 10;

Cmux is the capacitance value of the multiplex module 10;

Vmux is the voltage applied by the multiplex module 10;

fmux is the frequency of the respective switch control signals in the multiplex module 10;

Then, the power consumption of the multiplex module 10 is proportional to the frequency of the respective sub pixel switch control signals, and too fast switch frequency of the multiplex module 10 will lead to the excessive power consumption.

SUMMARY OF THE INVENTION

An objective of the present invention is to provide a drive method of a RGBW four primary colors display panel, which can reduce the power consumption of the multiplex module itself and the entire display panel.

For realizing the aforesaid objective, the present invention provides a drive method of a RGBW four primary colors display panel, for a drive architecture of driving eight columns of sub pixels by two source drive lines with multiplexing, adjusting an enable sequence of a red sub pixel switch control signal, a green sub pixel switch control signal, a blue sub pixel switch control signal and a white sub pixel switch control signal in a multiplex module to make that a duration of a portion of pulse high voltage levels in at least two sub pixel switch control signals is ½ of a duration of a pulse high voltage level of a gate scan signal, and middle points of the portion of pulse high voltage levels are aligned with a rising edge of one of three adjacent gate scan signals and a falling edge of one of the other two gate scan signals to reduce a switch frequency of a corresponding sub pixel switch control signal.

Selectably, the drive method of the RGBW four primary colors display panel comprises steps of:

step 1, providing the RGBW four primary colors display panel;

the RGBW four primary colors display panel comprising a plurality of drive units, and each unit comprising one multiplex module and a first column of pixels and a second column of pixels;

either of the first column of pixels and the second column of pixels comprising a red sub pixel, a green sub pixel, a blue sub pixel and a white sub pixel which are located from left to right in order; the multiplex module comprising a first thin film transistor, a second thin film transistor, a third thin film transistor, a fourth thin film transistor, a fifth thin film transistor, a sixth thin film transistor, a seventh thin film transistor, an eighth thin film transistor which are located from left to right in order;

a gate of the first thin film transistor receiving the red sub pixel switch control signal, and a source receiving a first source drive signal through a first source drive line, and a drain being coupled to the red sub pixel in the first column of pixels; a gate of the second thin film transistor receiving the green sub pixel switch control signal, and a source receiving the first source drive signal through the first source drive line, and a drain being coupled to the green sub pixel in the second column of pixels; a gate of the third thin film transistor receiving the blue sub pixel switch control signal, and a source receiving the first source drive signal through the first source drive line, and a drain being coupled to the blue sub pixel in the second column of pixels; a gate of the fourth thin film transistor receiving the white sub pixel switch control signal, and a source receiving the first source drive signal through the first source drive line, and a drain being coupled to the white sub pixel in the first column of pixels; a gate of the fifth thin film transistor receiving the red sub pixel switch control signal, and a source receiving a second source drive signal through a second source drive line, and a drain being coupled to the red sub pixel in the second column of pixels; a gate of the sixth thin film transistor receiving the green sub pixel switch control signal, and a source receiving the second source drive signal through the second source drive line, and a drain being coupled to the green sub pixel in the first column of pixels; a gate of the seventh thin film transistor receiving the blue sub pixel switch control signal, and a source receiving the second source drive signal through the second source drive line, and a drain being coupled to the blue sub pixel in the first column of pixels; a gate of the eighth thin film transistor receiving the white sub pixel switch control signal, and a source receiving the second source drive signal through the second source drive line, and a drain being coupled to the white sub pixel in the second column of pixels;

step 2, generating the gate scan signal row by row, and the red sub pixel switch control signal, the green sub pixel switch control signal, the blue sub pixel switch control signal and the white sub pixel switch control signal being pulled up in order all the time and in a chronological order, and before the one of the three adjacent gate scan signals generating the rising edge, and the one of the other two gate scan signals generating the falling edge, sequentially generating a wide pulse high voltage level of the white sub pixel switch control signal, a wide pulse high voltage level of the blue sub pixel switch control signal, a wide pulse high voltage level of the green sub pixel switch control signal and a wide pulse high voltage level of the red sub pixel switch control signal; a duration of the wide pulse high voltage levels being ½ of a duration of the pulse high voltage level of the gate scan signal, and middle points of the wide pulse high voltage levels being aligned with the rising edge of the one of the three adjacent gate scan signals and the falling edge of the one of the other two gate scan signals; all the rest pulse high voltage levels of the respective sub pixel switch control signals being narrow pulse high voltage levels, and a duration of the narrow pulse high voltage levels being ¼ of the duration of the pulse high voltage level of the gate scan signal;

the first source drive signal and the second source drive signal correspondingly charging a nth row of sub pixels in an order of the red sub pixel, the green sub pixel, the blue sub pixel, the white sub pixel, and n being a positive integer; charging a n+1th row of sub pixels in an order of the white sub pixel, the red sub pixel, the green sub pixel, the blue sub pixel; charging a n+2th row of sub pixels in an order of the blue sub pixel, the white sub pixel, the red sub pixel, the green sub pixel; charging a n+3th row of sub pixels in an order of the green sub pixel, the blue sub pixel, the white sub pixel, the red sub pixel, and so on.

The first source drive signal is amplified by a first amplifier, and the second source drive signal is amplified by a second amplifier.

Voltage polarities of the first source drive signal and the second source drive signal are opposite all the time; voltage polarities of the first source drive signals in two adjacent frames are opposite, and voltage polarities of the second source drive signals in two adjacent frames are opposite.

A duty ratio of the gate scan signal is ⅓.

Selectably, the drive method of the RGBW four primary colors display panel comprises steps of:

step 1, providing the RGBW four primary colors display panel;

the RGBW four primary colors display panel comprising a plurality of drive units, and each unit comprising one multiplex module and a first column of pixels and a second column of pixels;

either of the first column of pixels and the second column of pixels comprising a red sub pixel, a green sub pixel, a blue sub pixel and a white sub pixel which are located from left to right in order; the multiplex module comprising a first thin film transistor, a second thin film transistor, a third thin film transistor, a fourth thin film transistor, a fifth thin film transistor, a sixth thin film transistor, a seventh thin film transistor, an eighth thin film transistor which are located from left to right in order;

a gate of the first thin film transistor receiving the red sub pixel switch control signal, and a source receiving a first source drive signal through a first source drive line, and a drain being coupled to the red sub pixel in the first column of pixels; a gate of the second thin film transistor receiving the green sub pixel switch control signal, and a source receiving the first source drive signal through the first source drive line, and a drain being coupled to the green sub pixel in the second column of pixels; a gate of the third thin film transistor receiving the blue sub pixel switch control signal, and a source receiving the first source drive signal through the first source drive line, and a drain being coupled to the blue sub pixel in the second column of pixels; a gate of the fourth thin film transistor receiving the white sub pixel switch control signal, and a source receiving the first source drive signal through the first source drive line, and a drain being coupled to the white sub pixel in the first column of pixels; a gate of the fifth thin film transistor receiving the red sub pixel switch control signal, and a source receiving a second source drive signal through a second source drive line, and a drain being coupled to the red sub pixel in the second column of pixels; a gate of the sixth thin film transistor receiving the green sub pixel switch control signal, and a source receiving the second source drive signal through the second source drive line, and a drain being coupled to the green sub pixel in the first column of pixels; a gate of the seventh thin film transistor receiving the blue sub pixel switch control signal, and a source receiving the second source drive signal through the second source drive line, and a drain being coupled to the blue sub pixel in the first column of pixels; a gate of the eighth thin film transistor receiving the white sub pixel switch control signal, and a source receiving the second source drive signal through the second source drive line, and a drain being coupled to the white sub pixel in the second column of pixels;

step 2, generating the gate scan signal row by row, and the red sub pixel switch control signal, the green sub pixel switch control signal, the blue sub pixel switch control signal and the white sub pixel switch control signal being pulled up in a positive order and then being pulled up in an inverted order, and in a chronological order, and before the one of the three adjacent gate scan signals generating the rising edge, and the one of the other two gate scan signals generating the falling edge, sequentially generating a wide pulse high voltage level of the white sub pixel switch control signal and a wide pulse high voltage level of the red sub pixel switch control signal; a duration of the wide pulse high voltage levels being ½ of a duration of the pulse high voltage level of the gate scan signal, and middle points of the wide pulse high voltage levels being aligned with the rising edge of the one of the three adjacent gate scan signals and the falling edge of the one of the other two gate scan signals; all the rest pulse high voltage levels of the white sub pixel switch control signals and the red sub pixel switch control signals being narrow pulse high voltage levels, and all the pulse high voltage levels of the green sub pixel switch control signals and the blue sub pixel switch control signals being narrow pulse high voltage levels, and a duration of the narrow pulse high voltage levels being ¼ of the duration of the pulse high voltage level of the gate scan signal;

the first source drive signal and the second source drive signal correspondingly charging a nth row of sub pixels in an order of the red sub pixel, the green sub pixel, the blue sub pixel, the white sub pixel, and n being a positive integer; charging a n+1th row of sub pixels in an order of the white sub pixel, the blue sub pixel, the green sub pixel, the red sub pixel; and so on.

The first source drive signal is amplified by a first amplifier, and the second source drive signal is amplified by a second amplifier.

Voltage polarities of the first source drive signal and the second source drive signal are opposite all the time; voltage polarities of the first source drive signals in two adjacent frames are opposite, and voltage polarities of the second source drive signals in two adjacent frames are opposite.

A duty ratio of the gate scan signal is ⅓.

The present invention further provides a drive method of a RGBW four primary colors display panel, for a drive architecture of driving eight columns of sub pixels by two source drive lines with multiplexing, adjusting an enable sequence of a red sub pixel switch control signal, a green sub pixel switch control signal, a blue sub pixel switch control signal and a white sub pixel switch control signal in a multiplex module to make that a duration of a portion of pulse high voltage levels in at least two sub pixel switch control signals is ½ of a duration of a pulse high voltage level of a gate scan signal, and middle points of the portion of pulse high voltage levels are aligned with a rising edge of one of three adjacent gate scan signals and a falling edge of one of the other two gate scan signals to reduce a switch frequency of a corresponding sub pixel switch control signal;

the drive method comprising steps of:

step 1, providing the RGBW four primary colors display panel;

the RGBW four primary colors display panel comprising a plurality of drive units, and each unit comprising one multiplex module and a first column of pixels and a second column of pixels;

either of the first column of pixels and the second column of pixels comprising a red sub pixel, a green sub pixel, a blue sub pixel and a white sub pixel which are located from left to right in order; the multiplex module comprising a first thin film transistor, a second thin film transistor, a third thin film transistor, a fourth thin film transistor, a fifth thin film transistor, a sixth thin film transistor, a seventh thin film transistor, an eighth thin film transistor which are located from left to right in order;

a gate of the first thin film transistor receiving the red sub pixel switch control signal, and a source receiving a first source drive signal through a first source drive line, and a drain being coupled to the red sub pixel in the first column of pixels; a gate of the second thin film transistor receiving the green sub pixel switch control signal, and a source receiving the first source drive signal through the first source drive line, and a drain being coupled to the green sub pixel in the second column of pixels; a gate of the third thin film transistor receiving the blue sub pixel switch control signal, and a source receiving the first source drive signal through the first source drive line, and a drain being coupled to the blue sub pixel in the second column of pixels; a gate of the fourth thin film transistor receiving the white sub pixel switch control signal, and a source receiving the first source drive signal through the first source drive line, and a drain being coupled to the white sub pixel in the first column of pixels; a gate of the fifth thin film transistor receiving the red sub pixel switch control signal, and a source receiving a second source drive signal through a second source drive line, and a drain being coupled to the red sub pixel in the second column of pixels; a gate of the sixth thin film transistor receiving the green sub pixel switch control signal, and a source receiving the second source drive signal through the second source drive line, and a drain being coupled to the green sub pixel in the first column of pixels; a gate of the seventh thin film transistor receiving the blue sub pixel switch control signal, and a source receiving the second source drive signal through the second source drive line, and a drain being coupled to the blue sub pixel in the first column of pixels; a gate of the eighth thin film transistor receiving the white sub pixel switch control signal, and a source receiving the second source drive signal through the second source drive line, and a drain being coupled to the white sub pixel in the second column of pixels;

step 2, generating the gate scan signal row by row, and the red sub pixel switch control signal, the green sub pixel switch control signal, the blue sub pixel switch control signal and the white sub pixel switch control signal being pulled up in order all the time and in a chronological order, and before the one of the three adjacent gate scan signals generating the rising edge, and the one of the other two gate scan signals generating the falling edge, sequentially generating a wide pulse high voltage level of the white sub pixel switch control signal, a wide pulse high voltage level of the blue sub pixel switch control signal, a wide pulse high voltage level of the green sub pixel switch control signal and a wide pulse high voltage level of the red sub pixel switch control signal; a duration of the wide pulse high voltage levels being ½ of a duration of the pulse high voltage level of the gate scan signal, and middle points of the wide pulse high voltage levels being aligned with the rising edge of the one of the three adjacent gate scan signals and the falling edge of the one of the other two gate scan signals; all the rest pulse high voltage levels of the respective sub pixel switch control signals being narrow pulse high voltage levels, and a duration of the narrow pulse high voltage levels being ¼ of the duration of the pulse high voltage level of the gate scan signal;

the first source drive signal and the second source drive signal correspondingly charging a nth row of sub pixels in an order of the red sub pixel, the green sub pixel, the blue sub pixel, the white sub pixel, and n being a positive integer; charging a n+1th row of sub pixels in an order of the white sub pixel, the red sub pixel, the green sub pixel, the blue sub pixel; charging a n+2th row of sub pixels in an order of the blue sub pixel, the white sub pixel, the red sub pixel, the green sub pixel; charging a n+3th row of sub pixels in an order of the green sub pixel, the blue sub pixel, the white sub pixel, the red sub pixel, and so on;

wherein the first source drive signal is amplified by a first amplifier, and the second source drive signal is amplified by a second amplifier;

wherein voltage polarities of the first source drive signal and the second source drive signal are opposite all the time; voltage polarities of the first source drive signals in two adjacent frames are opposite, and voltage polarities of the second source drive signals in two adjacent frames are opposite.

The benefits of the present invention are: the present invention provides a drive method of a RGBW four primary colors display panel, for a drive architecture of driving eight columns of sub pixels by two source drive lines with multiplexing, adjusting an enable sequence of a red sub pixel switch control signal, a green sub pixel switch control signal, a blue sub pixel switch control signal and a white sub pixel switch control signal in a multiplex module to make that a duration of a portion of pulse high voltage levels in at least two sub pixel switch control signals is ½ of a duration of a pulse high voltage level of a gate scan signal, and middle points of the portion of pulse high voltage levels are aligned with a rising edge of one of three adjacent gate scan signals and a falling edge of one of the other two gate scan signals to reduce a switch frequency of a corresponding sub pixel switch control signal for realizing the power consumption reduction of the multiplex module itself and the entire display panel.

BRIEF DESCRIPTION OF THE DRAWINGS

In order to better understand the characteristics and technical aspect of the invention, please refer to the following detailed description of the present invention is concerned with the diagrams, however, provide reference to the accompanying drawings and description only and is not intended to be limiting of the invention.

In drawings.

DETAILED DESCRIPTION OF PREFERRED EMBODIMENTS

For better explaining the technical solution and the effect of the present invention, the present invention will be further described in detail with the accompanying drawings and the specific embodiments.

The present invention provides a drive method of a RGBW four primary colors display panel.

Figure 1:
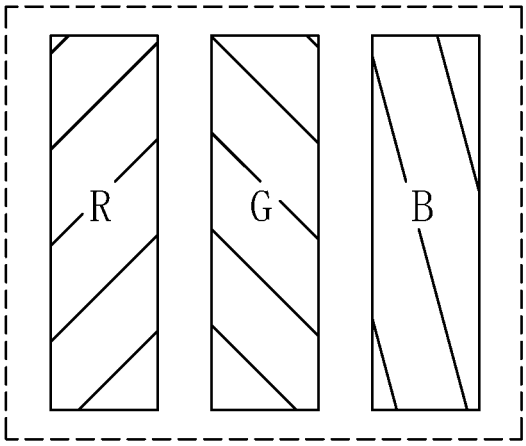
FIG. 1 is a diagram of a RGB pixel structure.
Figure 2:
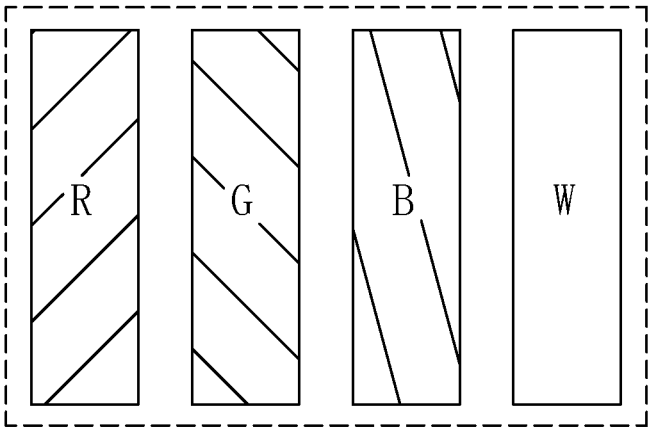
FIG. 2 is a diagram of a RGBW pixel structure.
Figure 3:
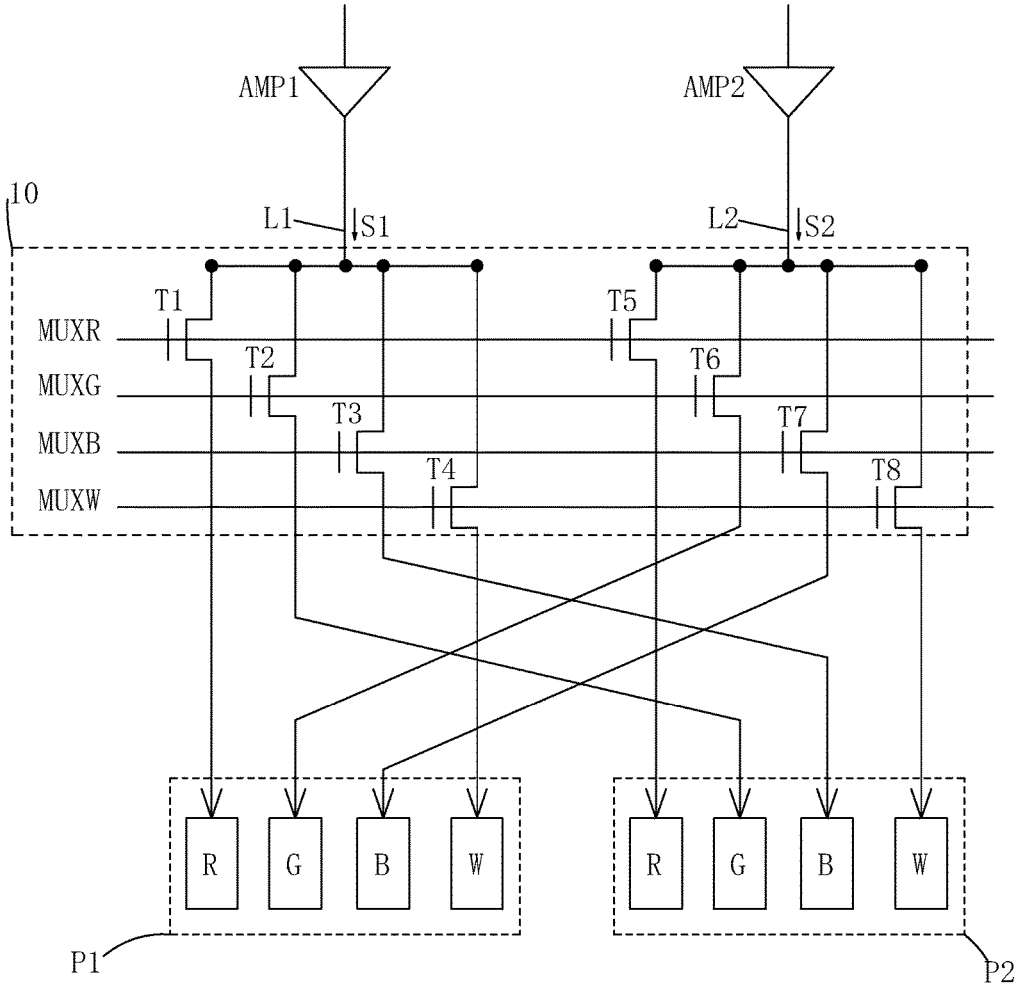
FIG. 3 is a circuit diagram of a drive unit in a RGBW four primary colors display panel.
Figure 4:
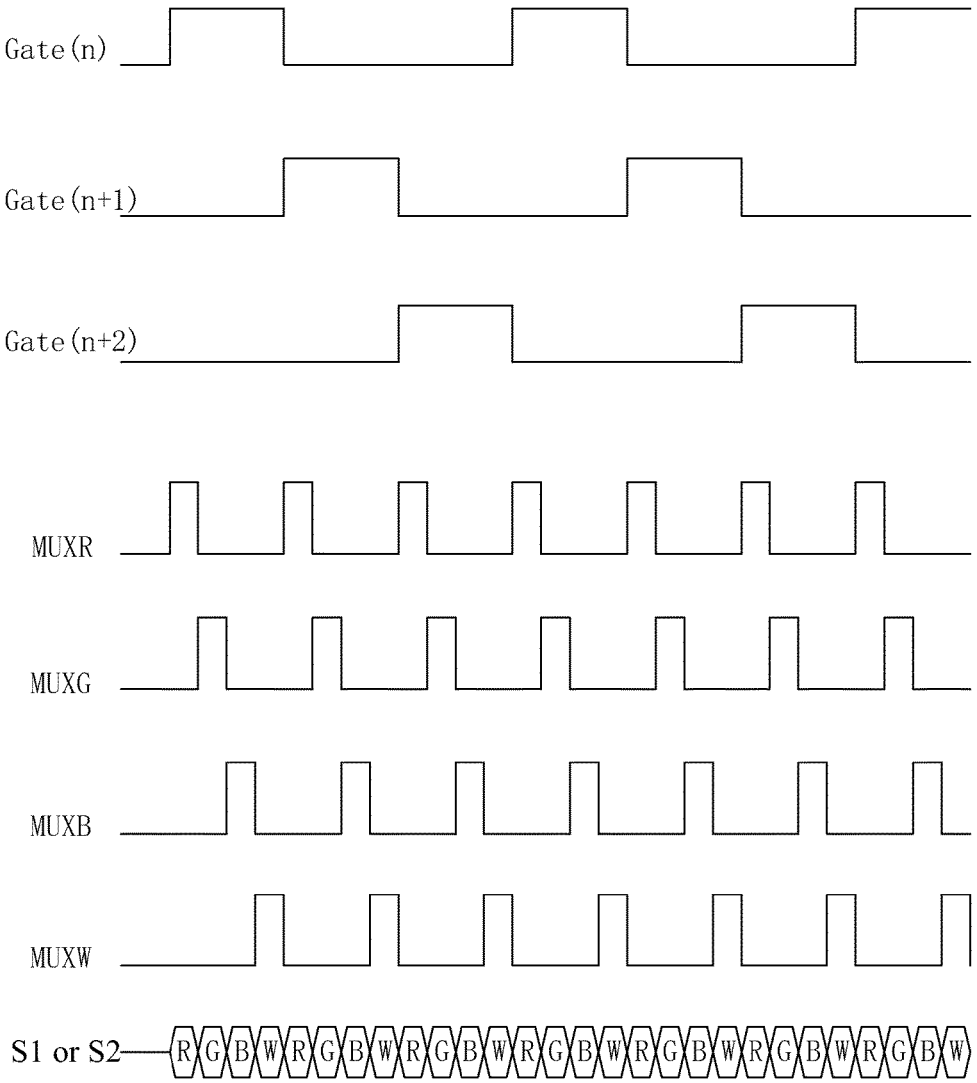
FIG. 4 is a sequence circuit diagram of a drive unit in a RGBW four primary colors display panel according to prior art.
Figure 5:
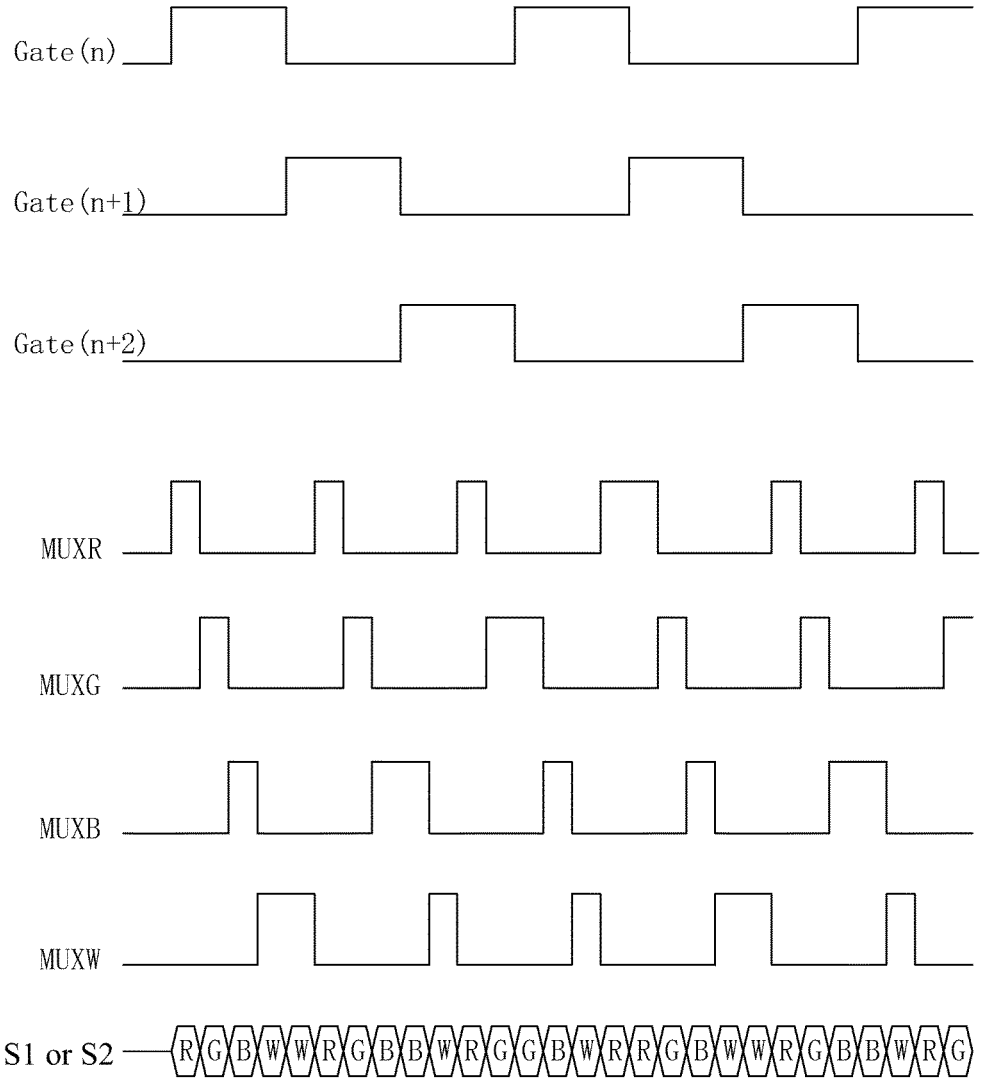
FIG. 5 is a sequence circuit diagram of the first embodiment of a drive method of a RGBW four primary colors display panel according to the present invention.

Please refer to FIG. 3 and FIG. 5. The first embodiment of a drive method of a RGBW four primary colors display panel according to the present invention comprises steps of:

step 1, providing the RGBW four primary colors display panel.

the RGBW four primary colors display panel comprising a plurality of drive units, and as shown in FIG. 3, each unit comprising one multiplex module 10 and a first column of pixels P1 and a second column of pixels P2;

either of the first column of pixels P1 and the second column of pixels P2 comprising a red sub pixel R, a green sub pixel G, a blue sub pixel B and a white sub pixel W which are located from left to right in order; the multiplex module 10 comprising a first thin film transistor T1, a second thin film transistor T2, a third thin film transistor T3, a fourth thin film transistor T4, a fifth thin film transistor T5, a sixth thin film transistor T6, a seventh thin film transistor T7, an eighth thin film transistor T8 which are located from left to right in order;

A gate of the first thin film transistor T1 receiving the red sub pixel switch control signal MUXR, and a source receiving a first source drive signal S1 through a first source drive line L1, and a drain being coupled to the red sub pixel R in the first column of pixels P1; a gate of the second thin film transistor T2 receiving the green sub pixel switch control signal MUXG, and a source receiving the first source drive signal S1 through the first source drive line L1, and a drain being coupled to the green sub pixel G in the second column of pixels P2; a gate of the third thin film transistor T3 receiving the blue sub pixel switch control signal MUXB, and a source receiving the first source drive signal S1 through the first source drive line L1, and a drain being coupled to the blue sub pixel B in the second column of pixels P2; a gate of the fourth thin film transistor T4 receiving the white sub pixel switch control signal MUXW, and a source receiving the first source drive signal S1 through the first source drive line L1, and a drain being coupled to the white sub pixel W in the first column of pixels P1; a gate of the fifth thin film transistor T5 receiving the red sub pixel switch control signal MUXR, and a source receiving a second source drive signal S2 through a second source drive line L2, and a drain being coupled to the red sub pixel R in the second column of pixels P2; a gate of the sixth thin film transistor T6 receiving the green sub pixel switch control signal MUXG, and a source receiving the second source drive signal S2 through the second source drive line L2, and a drain being coupled to the green sub pixel G in the first column of pixels P1; a gate of the seventh thin film transistor T7 receiving the blue sub pixel switch control signal MUXB, and a source receiving the second source drive signal S2 through the second source drive line L2, and a drain being coupled to the blue sub pixel B in the first column of pixels P1; a gate of the eighth thin film transistor T8 receiving the white sub pixel switch control signal MUXW, and a source receiving the second source drive signal S2 through the second source drive line L2, and a drain being coupled to the white sub pixel W in the second column of pixels P2.

Specifically, the first source drive signal S1 is amplified by a first amplifier AMP1, and the second source drive signal S2 is amplified by a second amplifier AMP2.

Voltage polarities of the first source drive signal S1 and the second source drive signal S2 are opposite all the time; voltage polarities of the first source drive signals S1 in two adjacent frames are opposite, and voltage polarities of the second source drive signals S2 in two adjacent frames are opposite. For instance, in the previous frame, the voltage polarity of the first source drive signal S1 is positive, and the voltage polarity of the second source drive signal S2 is negative, then in the next frame, the voltage polarity of the first source drive signal S1 is changed to be negative, and the voltage polarity of the second source drive signal S2 is changed to be positive for realizing the column inversion.

step 2, as shown in FIG. 5, generating the gate scan signal row by row, and the red sub pixel switch control signal MUXR, the green sub pixel switch control signal MUXG, the blue sub pixel switch control signal MUXB and the white sub pixel switch control signal MUXW being pulled up in order all the time and in a chronological order, and before the one of the three adjacent gate scan signals Gate(n), Gate(n+1), Gate(n+2) generating the rising edge, and the one of the other two gate scan signals generating the falling edge, sequentially generating a wide pulse high voltage level of the white sub pixel switch control signal MUXW, a wide pulse high voltage level of the blue sub pixel switch control signal MUXB, a wide pulse high voltage level of the green sub pixel switch control signal MUXG and a wide pulse high voltage level of the red sub pixel switch control signal MUXR; a duration of the wide pulse high voltage levels being ½ of a duration of the pulse high voltage level of the gate scan signal, and middle points of the wide pulse high voltage levels being aligned with the rising edge of the one of the three adjacent gate scan signals Gate(n), Gate(n+1), Gate(n+2) and the falling edge of the one of the other two gate scan signals; all the rest pulse high voltage levels of the respective sub pixel switch control signals being narrow pulse high voltage levels, and a duration of the narrow pulse high voltage levels being ¼ of the duration of the pulse high voltage level of the gate scan signal.

The first source drive signal S1 and the second source drive signal S2 correspondingly charging a nth row of sub pixels in an order of the red sub pixel R, the green sub pixel G, the blue sub pixel B, the white sub pixel W, and n being a positive integer; charging a n+1th row of sub pixels in an order of the white sub pixel W, the red sub pixel R, the green sub pixel G, the blue sub pixel B; charging a n+2th row of sub pixels in an order of the blue sub pixel B, the white sub pixel W, the red sub pixel R, the green sub pixel G; charging a n+3th row of sub pixels in an order of the green sub pixel G, the blue sub pixel B, the white sub pixel W, the red sub pixel R, and so on.

Specifically, a duty ratio of the gate scan signal is ⅓. Namely, in one cycle, a duration of the pulse high voltage level of the gate scan signal is ½ of a duration of the low voltage level.

In the first embodiment, by adjusting an enable sequence of a red sub pixel switch control signal MUXR, a green sub pixel switch control signal MUXG, a blue sub pixel switch control signal MUXB and a white sub pixel switch control signal MUXW in a multiplex module 10 to make that a duration of a portion of pulse high voltage levels in all the four sub pixel switch control signals is ½ of a duration of a pulse high voltage level of a gate scan signal, and middle points of the portion of pulse high voltage levels are aligned with a rising edge of one of three adjacent gate scan signals Gate(n), Gate(n+1), Gate(n+2) and a falling edge of one of the other two gate scan signals to reduce a switch frequency of all the four sub pixel switch control signals.

According to the power consumption calculation formula of the multiplex module:

$$Powermux=Cmux\times Vmux2\times fmux$$

wherein Powermux is the power consumption of the multiplex module 10;

Cmux is the capacitance value of the multiplex module 10;

Vmux is the voltage applied by the multiplex module 10;

fmux is the frequency of the respective switch control signals in the multiplex module 10;

The frequency of the respective sub pixel switch control signals is decreased, and then the power consumption of the multiplex module 10 is reduced along with, and the power consumption of the entire display panel is lowered, too.

Figure 6:
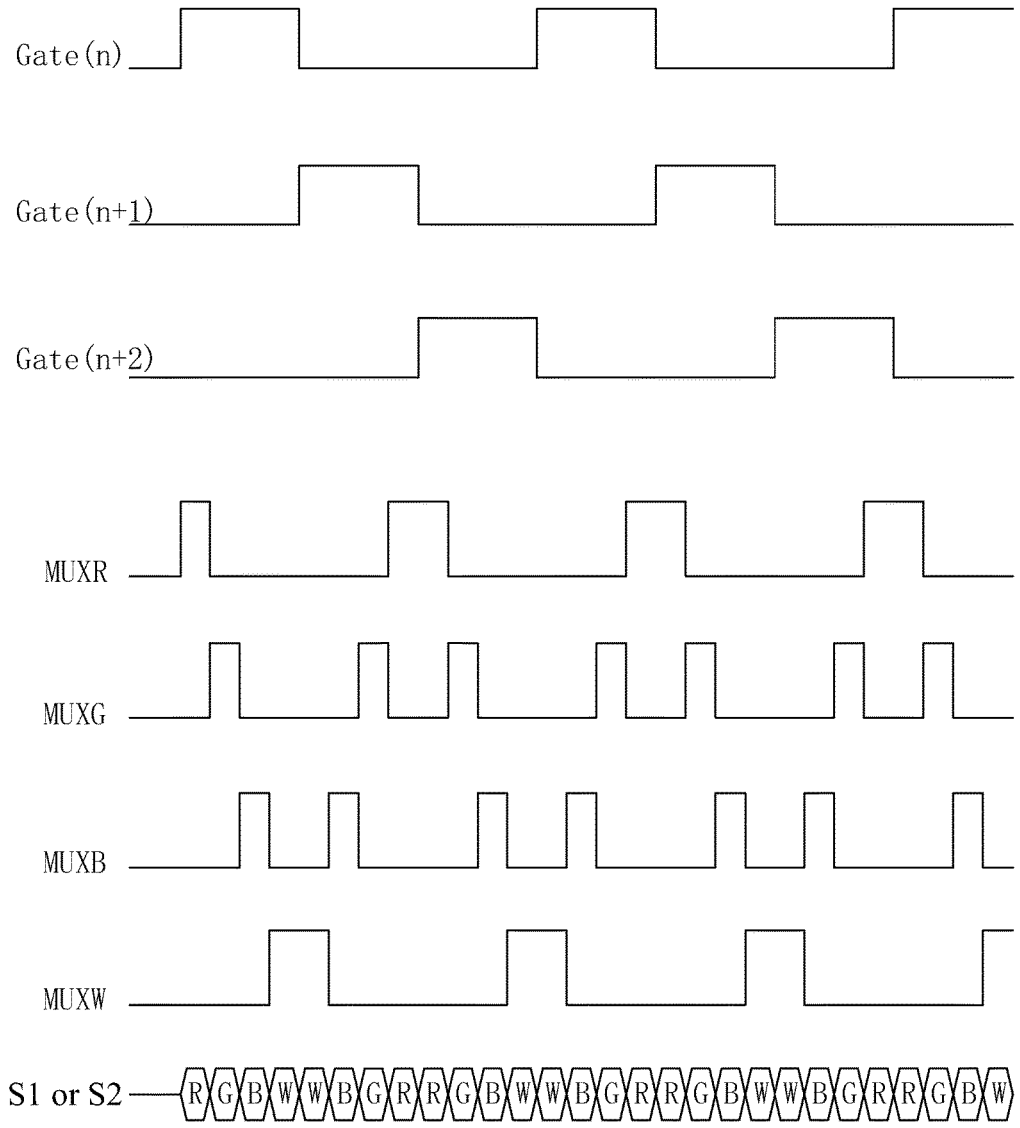
FIG. 6 is a sequence circuit diagram of the second embodiment of a drive method of a RGBW four primary colors display panel according to the present invention.

Please refer to FIG. 3 and FIG. 6. The second embodiment of a drive method of a RGBW four primary colors display panel according to the present invention comprises steps of:

step 1, providing the RGBW four primary colors display panel.

the RGBW four primary colors display panel comprising a plurality of drive units, and as shown in FIG. 3, each unit comprising one multiplex module 10 and a first column of pixels P1 and a second column of pixels P2;

either of the first column of pixels P1 and the second column of pixels P2 comprising a red sub pixel R, a green sub pixel G, a blue sub pixel B and a white sub pixel W which are located from left to right in order; the multiplex module 10 comprising a first thin film transistor T1, a second thin film transistor T2, a third thin film transistor T3, a fourth thin film transistor T4, a fifth thin film transistor T5, a sixth thin film transistor T6, a seventh thin film transistor T7, an eighth thin film transistor T8 which are located from left to right in order;

A gate of the first thin film transistor T1 receiving the red sub pixel switch control signal MUXR, and a source receiving a first source drive signal S1 through a first source drive line L1, and a drain being coupled to the red sub pixel R in the first column of pixels P1; a gate of the second thin film transistor T2 receiving the green sub pixel switch control signal MUXG, and a source receiving the first source drive signal S1 through the first source drive line L1, and a drain being coupled to the green sub pixel G in the second column of pixels P2; a gate of the third thin film transistor T3 receiving the blue sub pixel switch control signal MUXB, and a source receiving the first source drive signal S1 through the first source drive line L1, and a drain being coupled to the blue sub pixel B in the second column of pixels P2; a gate of the fourth thin film transistor T4 receiving the white sub pixel switch control signal MUXW, and a source receiving the first source drive signal S1 through the first source drive line L1, and a drain being coupled to the white sub pixel W in the first column of pixels P1; a gate of the fifth thin film transistor T5 receiving the red sub pixel switch control signal MUXR, and a source receiving a second source drive signal S2 through a second source drive line L2, and a drain being coupled to the red sub pixel R in the second column of pixels P2; a gate of the sixth thin film transistor T6 receiving the green sub pixel switch control signal MUXG, and a source receiving the second source drive signal S2 through the second source drive line L2, and a drain being coupled to the green sub pixel G in the first column of pixels P1; a gate of the seventh thin film transistor T7 receiving the blue sub pixel switch control signal MUXB, and a source receiving the second source drive signal S2 through the second source drive line L2, and a drain being coupled to the blue sub pixel B in the first column of pixels P1; a gate of the eighth thin film transistor T8 receiving the white sub pixel switch control signal MUXW, and a source receiving the second source drive signal S2 through the second source drive line L2, and a drain being coupled to the white sub pixel W in the second column of pixels P2.

Specifically, the first source drive signal S1 is amplified by a first amplifier AMP1, and the second source drive signal S2 is amplified by a second amplifier AMP2.

Voltage polarities of the first source drive signal S1 and the second source drive signal S2 are opposite all the time; voltage polarities of the first source drive signals S1 in two adjacent frames are opposite, and voltage polarities of the second source drive signals S2 in two adjacent frames are opposite. For instance, in the previous frame, the voltage polarity of the first source drive signal S1 is positive, and the voltage polarity of the second source drive signal S2 is negative, then in the next frame, the voltage polarity of the first source drive signal S1 is changed to be negative, and the voltage polarity of the second source drive signal S2 is changed to be positive for realizing the column inversion.

step 2, as shown in FIG. 6, generating the gate scan signal row by row, and the red sub pixel switch control signal MUXR, the green sub pixel switch control signal MUXG, the blue sub pixel switch control signal MUXB and the white sub pixel switch control signal MUXW being pulled up in a positive order (i.e. the order of red, green, blue, white) and then being pulled up in an inverted order (i.e. the order of white, blue, green, red), and in a chronological order, and before the one of the three adjacent gate scan signals Gate(n), Gate(n+1), Gate(n+2) generating the rising edge, and the one of the other two gate scan signals generating the falling edge, sequentially generating a wide pulse high voltage level of the white sub pixel switch control signal MUXW and a wide pulse high voltage level of the red sub pixel switch control signal MUXR; a duration of the wide pulse high voltage levels being ½ of a duration of the pulse high voltage level of the gate scan signal, and middle points of the wide pulse high voltage levels being aligned with the rising edge of the one of the three adjacent gate scan signals Gate(n), Gate(n+1), Gate(n+2) and the falling edge of the one of the other two gate scan signals; all the rest pulse high voltage levels of the white sub pixel switch control signals MUXW and the red sub pixel switch control signals MUXR being narrow pulse high voltage levels, and all the pulse high voltage levels of the green sub pixel switch control signals MUXG and the blue sub pixel switch control signals MUXB being narrow pulse high voltage levels, and a duration of the narrow pulse high voltage levels being ¼ of the duration of the pulse high voltage level of the gate scan signal;

the first source drive signal S1 and the second source drive signal S2 correspondingly charging a nth row of sub pixels in an order of the red sub pixel R, the green sub pixel G, the blue sub pixel B, the white sub pixel W, and n being a positive integer; charging a n+1th row of sub pixels in an order of the white sub pixel W, the blue sub pixel B, the green sub pixel G, the red sub pixel R; and so on.

Specifically, a duty ratio of the gate scan signal is ⅓. Namely, in one cycle, a duration of the pulse high voltage level of the gate scan signal is ½ of a duration of the low voltage level.

In the second embodiment, by adjusting an enable sequence of a red sub pixel switch control signal MUXR, a green sub pixel switch control signal MUXG, a blue sub pixel switch control signal MUXB and a white sub pixel switch control signal MUXW in a multiplex module 10 to make that a duration of a portion of pulse high voltage levels in the white sub pixel switch control signal MUXW and the red sub pixel switch control signal MUXR is ½ of a duration of a pulse high voltage level of a gate scan signal, and middle points of the portion of pulse high voltage levels are aligned with a rising edge of one of three adjacent gate scan signals Gate(n), Gate(n+1), Gate(n+2) and a falling edge of one of the other two gate scan signals to reduce a switch frequency of the white sub pixel switch control signal MUXW and the red sub pixel switch control signal MUXR.

According to the power consumption calculation formula of the multiplex module:

$$Powermux=Cmux\times Vmux2\times fmux$$

wherein Powermux is the power consumption of the multiplex module 10;

Cmux is the capacitance value of the multiplex module 10;

Vmux is the voltage applied by the multiplex module 10;

fmux is the frequency of the respective switch control signals in the multiplex module 10;

The frequency of the white sub pixel switch control signal and the red sub pixel switch control signal is decreased, and then the power consumption of the multiplex module 10 is reduced along with, and the power consumption of the entire display panel is lowered, too.

In conclusion, in the drive method of the RGBW four primary colors display panel according to the present invention, for a drive architecture of driving eight columns of sub pixels by two source drive lines with multiplexing, adjusting an enable sequence of a red sub pixel switch control signal, a green sub pixel switch control signal, a blue sub pixel switch control signal and a white sub pixel switch control signal in a multiplex module to make that a duration of a portion of pulse high voltage levels in at least two sub pixel switch control signals is ½ of a duration of a pulse high voltage level of a gate scan signal, and middle points of the portion of pulse high voltage levels are aligned with a rising edge of one of three adjacent gate scan signals and a falling edge of one of the other two gate scan signals to reduce a switch frequency of a corresponding sub pixel switch control signal for realizing the power consumption reduction of the multiplex module itself and the entire display panel.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A drive method of a RGBW four primary colors display panel, for a drive architecture of driving eight columns of sub pixels by two source drive lines with multiplexing, adjusting an enable sequence of a red sub pixel switch control signal, a green sub pixel switch control signal, a blue sub pixel switch control signal and a white sub pixel switch control signal in a multiplex module to make that a duration of a portion of pulse high voltage levels in at least two sub pixel switch control signals is ½ of a duration of a pulse high voltage level of a gate scan signal, and middle points of the portion of pulse high voltage levels are aligned with a rising edge of one of three adjacent gate scan signals and a falling edge of one of the other two gate scan signals to reduce a switch frequency of a corresponding sub pixel switch control signal;

the drive method comprising steps of:

step 1, providing the RGBW four primary colors display panel;

the RGBW four primary colors display panel comprising a plurality of drive units, and each unit comprising one multiplex module and a first column of pixels and a second column of pixels;

either of the first column of pixels and the second column of pixels comprising a red sub pixel, a green sub pixel, a blue sub pixel and a white sub pixel which are located from left to right in order; the multiplex module comprising a first thin film transistor, a second thin film transistor, a third thin film transistor, a fourth thin film transistor, a fifth thin film transistor, a sixth thin film transistor, a seventh thin film transistor, an eighth thin film transistor which are located from left to right in order;

a gate of the first thin film transistor receiving the red sub pixel switch control signal, and a source receiving a first source drive signal through a first source drive line, and a drain being coupled to the red sub pixel in the first column of pixels; a gate of the second thin film transistor receiving the green sub pixel switch control signal, and a source receiving the first source drive signal through the first source drive line, and a drain being coupled to the green sub pixel in the second column of pixels; a gate of the third thin film transistor receiving the blue sub pixel switch control signal, and a source receiving the first source drive signal through the first source drive line, and a drain being coupled to the blue sub pixel in the second column of pixels; a gate of the fourth thin film transistor receiving the white sub pixel switch control signal, and a source receiving the first source drive signal through the first source drive line, and a drain being coupled to the white sub pixel in the first column of pixels; a gate of the fifth thin film transistor receiving the red sub pixel switch control signal, and a source receiving a second source drive signal through a second source drive line, and a drain being coupled to the red sub pixel in the second column of pixels; a gate of the sixth thin film transistor receiving the green sub pixel switch control signal, and a source receiving the second source drive signal through the second source drive line, and a drain being coupled to the green sub pixel in the first column of pixels; a gate of the seventh thin film transistor receiving the blue sub pixel switch control signal, and a source receiving the second source drive signal through the second source drive line, and a drain being coupled to the blue sub pixel in the first column of pixels; a gate of the eighth thin film transistor receiving the white sub pixel switch control signal, and a source receiving the second source drive signal through the second source drive line, and a drain being coupled to the white sub pixel in the second column of pixels;

step 2, generating the gate scan signal row by row, and the red sub pixel switch control signal, the green sub pixel switch control signal, the blue sub pixel switch control signal and the white sub pixel switch control signal being pulled up in order all the time and in a chronological order, and before the one of the three adjacent gate scan signals generating the rising edge, and the one of the other two gate scan signals generating the falling edge, sequentially generating a wide pulse high voltage level of the white sub pixel switch control signal, a wide pulse high voltage level of the blue sub pixel switch control signal, a wide pulse high voltage level of the green sub pixel switch control signal and a wide pulse high voltage level of the red sub pixel switch control signal; a duration of the wide pulse high voltage levels being ½ of a duration of the pulse high voltage level of the gate scan signal, and middle points of the wide pulse high voltage levels being aligned with the rising edge of the one of the three adjacent gate scan signals and the falling edge of the one of the other two gate scan signals; all the rest pulse high voltage levels of the respective sub pixel switch control signals being narrow pulse high voltage levels, and a duration of the narrow pulse high voltage levels being 1/1 of the duration of the pulse high voltage level of the gate scan signal;

the first source drive signal and the second source drive signal correspondingly charging a nth row of sub pixels in an order of the red sub pixel, the green sub pixel, the blue sub pixel, the white sub pixel, and n being a positive integer; charging a n+1th row of sub pixels in an order of the white sub pixel, the red sub pixel, the green sub pixel, the blue sub pixel; charging a n+2th row of sub pixels in an order of the blue sub pixel, the white sub pixel, the red sub pixel, the green sub pixel; charging a n+3th row of sub pixels in an order of the green sub pixel, the blue sub pixel, the white sub pixel, the red sub pixel, and so on;

wherein the first source drive signal is amplified by a first amplifier, and the second source drive signal is amplified by a second amplifier;

wherein voltage polarities of the first source drive signal and the second source drive signal are opposite all the time; voltage polarities of the first source drive signals in two adjacent frames are opposite, and voltage polarities of the second source drive signals in two adjacent frames are opposite.

2. The drive method of the RGBW four primary colors display panel according to claim 1, wherein a duty ratio of the gate scan signal is ⅓.

3. A drive method of a RGBW four primary colors display panel, for a drive architecture of driving eight columns of sub pixels by two source drive lines with multiplexing, adjusting an enable sequence of a red sub pixel switch control signal, a green sub pixel switch control signal, a blue sub pixel switch control signal and a white sub pixel switch control signal in a multiplex module to make that a duration of a portion of pulse high voltage levels in at least two sub pixel switch control signals is ½ of a duration of a pulse high voltage level of a gate scan signal, and middle points of the portion of pulse high voltage levels are aligned with a rising edge of one of three adjacent gate scan signals and a falling edge of one of the other two gate scan signals to reduce a switch frequency of a corresponding sub pixel switch control signal.

4. The drive method of the RGBW four primary colors display panel according to claim 3, comprising steps of:

step 1, providing the RGBW four primary colors display panel;

the RGBW four primary colors display panel comprising a plurality of drive units, and each unit comprising one multiplex module and a first column of pixels and a second column of pixels;

either of the first column of pixels and the second column of pixels comprising a red sub pixel, a green sub pixel, a blue sub pixel and a white sub pixel which are located from left to right in order; the multiplex module comprising a first thin film transistor, a second thin film transistor, a third thin film transistor, a fourth thin film transistor, a fifth thin film transistor, a sixth thin film transistor, a seventh thin film transistor, an eighth thin film transistor which are located from left to right in order;

a gate of the first thin film transistor receiving the red sub pixel switch control signal, and a source receiving a first source drive signal through a first source drive line, and a drain being coupled to the red sub pixel in the first column of pixels; a gate of the second thin film transistor receiving the green sub pixel switch control signal, and a source receiving the first source drive signal through the first source drive line, and a drain being coupled to the green sub pixel in the second column of pixels; a gate of the third thin film transistor receiving the blue sub pixel switch control signal, and a source receiving the first source drive signal through the first source drive line, and a drain being coupled to the blue sub pixel in the second column of pixels; a gate of the fourth thin film transistor receiving the white sub pixel switch control signal, and a source receiving the first source drive signal through the first source drive line, and a drain being coupled to the white sub pixel in the first column of pixels; a gate of the fifth thin film transistor receiving the red sub pixel switch control signal, and a source receiving a second source drive signal through a second source drive line, and a drain being coupled to the red sub pixel in the second column of pixels; a gate of the sixth thin film transistor receiving the green sub pixel switch control signal, and a source receiving the second source drive signal through the second source drive line, and a drain being coupled to the green sub pixel in the first column of pixels; a gate of the seventh thin film transistor receiving the blue sub pixel switch control signal, and a source receiving the second source drive signal through the second source drive line, and a drain being coupled to the blue sub pixel in the first column of pixels; a gate of the eighth thin film transistor receiving the white sub pixel switch control signal, and a source receiving the second source drive signal through the second source drive line, and a drain being coupled to the white sub pixel in the second column of pixels;

step 2, generating the gate scan signal row by row, and the red sub pixel switch control signal, the green sub pixel switch control signal, the blue sub pixel switch control signal and the white sub pixel switch control signal being pulled up in order all the time and in a chronological order, and before the one of the three adjacent gate scan signals generating the rising edge, and the one of the other two gate scan signals generating the falling edge, sequentially generating a wide pulse high voltage level of the white sub pixel switch control signal, a wide pulse high voltage level of the blue sub pixel switch control signal, a wide pulse high voltage level of the green sub pixel switch control signal and a wide pulse high voltage level of the red sub pixel switch control signal; a duration of the wide pulse high voltage levels being ½ of a duration of the pulse high voltage level of the gate scan signal, and middle points of the wide pulse high voltage levels being aligned with the rising edge of the one of the three adjacent gate scan signals and the falling edge of the one of the other two gate scan signals; all the rest pulse high voltage levels of the respective sub pixel switch control signals being narrow pulse high voltage levels, and a duration of the narrow pulse high voltage levels being ¼ of the duration of the pulse high voltage level of the gate scan signal;

the first source drive signal and the second source drive signal correspondingly charging a nth row of sub pixels in an order of the red sub pixel, the green sub pixel, the blue sub pixel, the white sub pixel, and n being a positive integer; charging a n+1th row of sub pixels in an order of the white sub pixel, the red sub pixel, the green sub pixel, the blue sub pixel; charging a n+2th row of sub pixels in an order of the blue sub pixel, the white sub pixel, the red sub pixel, the green sub pixel; charging a n+3th row of sub pixels in an order of the green sub pixel, the blue sub pixel, the white sub pixel, the red sub pixel, and so on.

5. The drive method of the RGBW four primary colors display panel according to claim 4, wherein the first source drive signal is amplified by a first amplifier, and the second source drive signal is amplified by a second amplifier.

6. The drive method of the RGBW four primary colors display panel according to claim 4, wherein voltage polarities of the first source drive signal and the second source drive signal are opposite all the time; voltage polarities of the first source drive signals in two adjacent frames are opposite, and voltage polarities of the second source drive signals in two adjacent frames are opposite.

7. The drive method of the RGBW four primary colors display panel according to claim 4, wherein a duty ratio of the gate scan signal is ⅓.

8. The drive method of the RGBW four primary colors display panel according to claim 3, comprising steps of:

step 1, providing the RGBW four primary colors display panel;

the RGBW four primary colors display panel comprising a plurality of drive units, and each unit comprising one multiplex module and a first column of pixels and a second column of pixels;

either of the first column of pixels and the second column of pixels comprising a red sub pixel, a green sub pixel, a blue sub pixel and a white sub pixel which are located from left to right in order; the multiplex module comprising a first thin film transistor, a second thin film transistor, a third thin film transistor, a fourth thin film transistor, a fifth thin film transistor, a sixth thin film transistor, a seventh thin film transistor, an eighth thin film transistor which are located from left to right in order;

a gate of the first thin film transistor receiving the red sub pixel switch control signal, and a source receiving a first source drive signal through a first source drive line, and a drain being coupled to the red sub pixel in the first column of pixels; a gate of the second thin film transistor receiving the green sub pixel switch control signal, and a source receiving the first source drive signal through the first source drive line, and a drain being coupled to the green sub pixel in the second column of pixels; a gate of the third thin film transistor receiving the blue sub pixel switch control signal, and a source receiving the first source drive signal through the first source drive line, and a drain being coupled to the blue sub pixel in the second column of pixels; a gate of the fourth thin film transistor receiving the white sub pixel switch control signal, and a source receiving the first source drive signal through the first source drive line, and a drain being coupled to the white sub pixel in the first column of pixels; a gate of the fifth thin film transistor receiving the red sub pixel switch control signal, and a source receiving a second source drive signal through a second source drive line, and a drain being coupled to the red sub pixel in the second column of pixels; a gate of the sixth thin film transistor receiving the green sub pixel switch control signal, and a source receiving the second source drive signal through the second source drive line, and a drain being coupled to the green sub pixel in the first column of pixels; a gate of the seventh thin film transistor receiving the blue sub pixel switch control signal, and a source receiving the second source drive signal through the second source drive line, and a drain being coupled to the blue sub pixel in the first column of pixels; a gate of the eighth thin film transistor receiving the white sub pixel switch control signal, and a source receiving the second source drive signal through the second source drive line, and a drain being coupled to the white sub pixel in the second column of pixels;

step 2, generating the gate scan signal row by row, and the red sub pixel switch control signal, the green sub pixel switch control signal, the blue sub pixel switch control signal and the white sub pixel switch control signal being pulled up in a positive order and then being pulled up in an inverted order, and in a chronological order, and before the one of the three adjacent gate scan signals generating the rising edge, and the one of the other two gate scan signals generating the falling edge, sequentially generating a wide pulse high voltage level of the white sub pixel switch control signal and a wide pulse high voltage level of the red sub pixel switch control signal; a duration of the wide pulse high voltage levels being ½ of a duration of the pulse high voltage level of the gate scan signal, and middle points of the wide pulse high voltage levels being aligned with the rising edge of the one of the three adjacent gate scan signals and the falling edge of the one of the other two gate scan signals; all the rest pulse high voltage levels of the white sub pixel switch control signals and the red sub pixel switch control signals being narrow pulse high voltage levels, and all the pulse high voltage levels of the green sub pixel switch control signals and the blue sub pixel switch control signals being narrow pulse high voltage levels, and a duration of the narrow pulse high voltage levels being ¼ of the duration of the pulse high voltage level of the gate scan signal;

the first source drive signal and the second source drive signal correspondingly charging a nth row of sub pixels in an order of the red sub pixel, the green sub pixel, the blue sub pixel, the white sub pixel, and n being a positive integer; charging a n+1th row of sub pixels in an order of the white sub pixel, the blue sub pixel, the green sub pixel, the red sub pixel; and so on.

9. The drive method of the RGBW four primary colors display panel according to claim 8, wherein the first source drive signal is amplified by a first amplifier, and the second source drive signal is amplified by a second amplifier.

10. The drive method of the RGBW four primary colors display panel according to claim 8, wherein voltage polarities of the first source drive signal and the second source drive signal are opposite all the time; voltage polarities of the first source drive signals in two adjacent frames are opposite, and voltage polarities of the second source drive signals in two adjacent frames are opposite.

11. The drive method of the RGBW four primary colors display panel according to claim 8, wherein a duty ratio of the gate scan signal is ⅓.

* * * * *